United States Patent [19]

Kato et al.

[11] Patent Number: 4,996,121

[45] Date of Patent: Feb. 26, 1991

[54] ELECTROPHOTOGRAPHIC LITHOGRAPHIC PRINTING PLATE PRECURSOR CONTAINING RESIN HAVING HYDROXY GROUP FORMING FUNCTIONAL GROUP

[75] Inventors: Eiichi Kato; Kazuo Ishii, both of Shizuoka, Japan

[73] Assignee: Fuji Photo Film Co., Ltd., Kanagawa, Japan

[21] Appl. No.: 293,400

[22] Filed: Jan. 4, 1989

[30] Foreign Application Priority Data

Jan. 6, 1988 [JP] Japan ..... 63-265
Jan. 27, 1988 [JP] Japan ..... 63-14577

[51] Int. Cl.[5] ..... G03G 5/087

[52] U.S. Cl. ..... 430/87; 430/96; 430/78; 430/49

[58] Field of Search ..... 430/96, 87, 78, 49

[56] References Cited

U.S. PATENT DOCUMENTS 3,776,724 12/1973 Usmani ..... 430/96
3,912,506 10/1975 Merrill ..... 430/96
3,932,181 1/1976 Ray-Chaudhuri et al. ..... 430/96
4,547,447 10/1985 Ueda ..... 430/78
4,828,952 5/1989 Kato et al. ..... 430/87

*Primary Examiner*—Marion C. McCamish
*Assistant Examiner*—Christopher D. RoDee
*Attorney, Agent, or Firm*—Sughrue, Mion, Zinn, Macpeak & Seas

[57] ABSTRACT

An electrophotographic lithographic printing plate precursor comprising a conductive support having provided thereon at least one photoconductive layer containing photocondutive zinc oxide and a resin binder is disclosed, wherein the resin binder comprises at least one resin (A) containing at least one functional group capable of forming at least one hydroxyl group upon decomposition and at least one member selected from the group consisting of (B) a heat- and/or photo-curable resin and a crosslinking agent. Since the hydroxyl group formed in the resin (A) enhances hydrophilic properties of nonimage areas, the printing plate obtained from the precursor is resistant to background stains. This effect is further ensured by the crosslinked structure formed between the resin (A) and the resin (B) and/or a crosslinking agent.

10 Claims, No Drawings

ELECTROPHOTOGRAPHIC LITHOGRAPHIC PRINTING PLATE PRECURSOR CONTAINING RESIN HAVING HYDROXY GROUP FORMING FUNCTIONAL GROUP

FIELD OF THE INVENTION

This invention relates to an electrophotographic lithographic printing plate precursor and, more particularly, to an improved resin binder forming a photoconductive layer of a lithographic printing plate precursor.

BACKGROUND OF THE INVENTION

A number of offset printing plate precursors for directly producing printing plates have hitherto been proposed, and some of which have already been put to practical use. A system in which a photoreceptor comprising a conductive support having provided thereon a photoconductive layer mainly comprising photoconductive particles, e.g., zinc oxide, and a resin binder is subjected to an ordinary electrophotographic processing to form a highly lipophilic toner image thereon and the surface of the photoreceptor is then treated with an oil-desensitizing solution, referred to as an etching solution, to selectively render nonimage areas hydrophilic, to thereby obtain an offset printing plate, has been widely employed.

Requirements of offset printing plate precursors for obtaining satisfactory prints are such that: an original should be reproduced faithfully on the photoreceptor; the surface of a photoreceptor has an affinity for an oil-desensitizing solution so as to render nonimage areas sufficiently hydrophilic, while, at the same time, having water resistance; and that a photoconductive layer having an image formed thereon is not released during printing and is receptive to dampening water so that the nonimage areas hold the hydrophilic properties enough to be free from stains even on printing a large number of prints.

It is known that the above performance properties of printing plate precursors are influenced by the ratio of zinc oxide to resin binder in the photoconductive layer. For example, as the ratio of resin binder to zinc oxide particles becomes small, oildesensitization of the surface of the photoconductive layer is increased to reduce background stains, but, in turn, the internal cohesion of the photoconductive layer per se is weakened, resulting in reduction of printing durability due to insufficient mechanical strength. On the other hand, as the proportion of the resin binder increases, printing durability is improved, but background staining tends to become conspicuous. With respect to background staining, while it is a phenomenon associated with the degree of oil-desensitization achieved, it has been found that the oil-desensitization of the photoconductive layer surface depends not only on the zinc oxide/resin binder ratio in the photoconductive layer, but also depends greatly on the kind of the resin binder used.

Resin binders which have been conventionally known include silicone resins (see JP-B-34-6670, the term "JP-B" as used herein refers to an "examined Japanese patent publication"), styrene-butadiene resins (see JP-B-35-1950), alkyd resins, maleic acid resins, polyamides (see JP-B-35-11219), vinyl acetate resins (see JP-B-41-2425), vinyl acetate copolymer resins (see JP-B-41-2426), acrylic resins (see JP-B-35-11216), acrylic ester copolymer resins (see JP-B-35-11219, JP-B-36-8510 and JP-B-41-13946). However, electrophotographic light-sensitive materials using these known resins suffer from disadvantages, such as low charging characteristics of the photoconductive layer; poor quality of a reproduced image, particularly dot reproducibility or resolving power; low sensitivity to exposure; insufficient oil-desensitization attained by oil-desensitization for use as an offset master, which results in background stains on prints when used for offset printing; insufficient film strength of the light-sensitive layer, which causes release of the light-sensitive layer during offset printing, thus failing to obtain a large number of prints; susceptibility of image quality to influences of environment at the time of electrophotographic image formation, such as high temperature and high humidity.

For the particular use as an offset printing plate precursor, formation of background stains due to insufficient oil-desensitization presents a serious problem. In order to solve this problem, various resins have been proposed as binders for zinc oxide, including a resin having a molecular weight of from $1.8\times10^4$ to $1\times10^5$ and a glass transition point of from 10° to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in JP-B-50-31011; a terpolymer containing a (meth)acrylic ester unit having a substituent having a carboxylic group at least 7 atoms distant from the ester linkage as disclosed in JP-A-53-54027 (the term "JP-A" as used herein refers to a "published unexamined Japanese patent application"); a tetra- or pentamer containing an acrylic acid unit and a hydroxyethyl (meth)acrylate unit as disclosed in JP-A-54-20735 and JP-A-57-202544; a terpolymer containing a (meth)acrylic ester unit having an alkyl group having from 6 to 12 carbon atoms as a substituent and a vinyl monomer containing a carboxylic acid group as disclosed in JP-A-58-68046.

Nevertheless, evaluations of these resins proposed for improving oil-desensitization revealed that none of them is fully satisfactory in terms of stain resistance and printing durability.

Resins having a functional group capable of forming a hydrophilic group on decomposition have been studied for use as binders. For example, resins having a functional group capable of forming a hydroxyl group on decomposition as disclosed in JP-A-62-195684, JP-A-62-41-2426), and JP-A-62-210476, and resins having a functional group capable of forming a carboxyl group on decomposition as disclosed in JP-A-62-21269, have been proposed.

These functional group-containing resins form a hydrophilic group upon hydrolysis or hydrogenolysis with an oil-desensitizing solution or dampening water used during printing. It has been reported that the use of these resins as binders in lithographic printing plate precursors can avoid various problems associated with use of resins containing a hydrophilic group, such as deterioration of surface smoothness and electrophotographic photographic characteristics, which seem ascribable to the strong interaction between the hydrophilic group and the surface of the photoconductive zinc oxide particles. That is, when the resin containing a hydrophilic group is used as a binder, the binder adheres strongly to the surface of zinc oxide, thereby causing adverse effects, since (1) the hydrophilic property of zinc oxide is deteriorated and, thus, background stains tend to be generated due to inherently strong oleophilic property of the binder, and (2) the mechanical strength of the film formed lowers, thereby reducing the printing durability of the resulting printing plate. It has also been expected that the hydrophilic properties of the nonimage areas attained by an oil-desensitizing solution can be enhanced by the hydrophilic group formed by decomposition of the resin so that a clear distinction can be made between the lipophilic image area and the hydrophilic nonimage area. Adhesion of a printing ink onto the nonimage areas during printing can thus be prevented, thereby making it possible to obtain a large number of prints having a clear image free from background stains.

However, the above-described functional group-containing resins capable of forming a hydrophilic group are still unsatisfactory in resistance to background stain and printing durability. In particular, the resin becomes water-soluble as its amount is increased for the purpose of further improving hydrophilic properties of the nonimage areas, thus impairing durability of the hydrophilic properties. Hence, there is a demand to develop a technique by which the hydrophilic properties of the nonimage areas can be assured while lasting long. Namely, it has been keenly demanded to establish a technique to improve hydrophilic properties. Specifically, hydrophilic properties can be retained or rather enhanced even if the proportion of the resin containing a hydrophilic group-forming functional group in the total resin binder is decreased, or a large number of clear prints can be obtained without suffering from background stains even under strict printing conditions resulting from an increase of a printing machine size or variation of printing pressure.

SUMMARY OF THE INVENTION

One object of the present invention is to provide a lithographic printing plate precursor which reproduces an image faithful to an original, exhibits satisfactory hydrophilic properties on the nonimage areas thereby forming no background stains, exhibits satisfactory surface smoothness and electrophotographic characteristics, and excellent printing durability.

Another object of the present invention is to provide a lithographic printing plate precursor which is not influenced by variable environmental conditions of electrophotographic processing, and exhibits excellent preservability before processing.

It has now been found that the above objects can be accomplished by an electrophotographic lithographic printing plate precursor obtained from an electrophotographic photoreceptor comprising a conductive support having provided thereon at least one photoconductive layer containing photoconductive zinc oxide and a resin binder, wherein said resin binder comprises at least one resin (A) containing at least one functional group capable of forming at least one hydroxyl group upon decomposition and at least one member selected from the group consisting of (B) a heat- and/or photo-curable resin and a crosslinking agent.

The feature of the present invention lies in the use of the resin (A) containing a functional group capable of forming a hydroxyl group on decomposition in combination with (B) the heat- and/or photo-curable resin and/or crosslinking agent which forms a crosslinked structure between polymer components.

DETAILED DESCRIPTION OF THE INVENTION

The resin which can be used in the present invention as a binder contains (A) at least one resin containing at least one functional group capable of forming one or more hydroxyl groups upon decomposition (hereinafter referred to as hydroxyl-forming functional group-containing resin) and (B) a heat- and/or photocurable resin and/or a crosslinking agent.

In a preferred embodiment of the present invention, the hydroxyl-forming functional group contained in the resin (A) is represented by formula (I):

$$-O-L \qquad (I)$$

wherein L represents $$-\overset{\overset{R_1}{|}}{\underset{\underset{R_3}{|}}{Si}}-R_2,\ -CO-Y_1,\ -CO-T-Y_2,\ -CH=CH-CH_3,$$

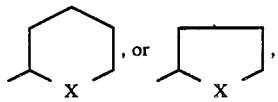

wherein $R_1$, $R_2$, and $R_3$, which may be the same or different, each represents a hydrogen atom, a hydrocarbon group, or —O—R', wherein R' represents a hydrocarbon group; X represents a sulfur atom or an oxygen atom; $Y_1$ and $Y_2$ each represents a hydrocarbon group; and T represents an oxygen atom, a sulfur atom, or —NH—.

In formula (I), $R_1$, $R_2$, and $R_3$ each preferably represents a hydrogen atom, a substituted or unsubstituted straight chain or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), a substituted or unsubstituted alicyclic group (e.g., cyclopentyl, cyclohexyl), a substituted or unsubstituted aralkyl group having from 7 to 12 carbon atoms (e.g., benzyl, phenethyl, fluorobenzyl, chlorobenzyl, methylbenzyl, methoxybenzyl, 3phenylpropyl), a substituted or unsubstituted aromatic group (e.g., phenyl, naphthyl, chlorophenyl, tolyl, methoxyphenyl, methoxycarbonylphenyl, dichlorophenyl), or —O—$R_4$, wherein $R_4$ represents a hydrocarbon group, and more specifically includes the hydrocarbon groups as recited for $R_1$, $R_2$, and $R_3$.

$Y_1$ and $Y_2$ each preferably represents a substituted or unsubstituted straight chain or branched alkyl group having from 1 to 6 carbon atoms (e.g., methyl, trichloromethyl, trifluoromethyl, methoxymethyl, phenoxymethyl, 2,2,2-trifluoroethyl, t-butyl, hexafluoroisopropyl), a substituted or unsubstituted aralkyl group having from 7 to 9 carbon atoms (e.g., benzyl, phenethyl, methylbenzyl, trimethylbenzyl, heptamethylbenzyl, methoxybenzyl), or a substituted or unsubstituted aryl group having from 6 to 12 carbon atoms (e.g., phenyl, nitrophenyl, cyanophenyl, methanesulfonylphenyl, methoxyphenyl, butoxyphenyl, chlorophenyl, dichlorophenyl, trifluoromethylphenyl).

T represents an oxygen atom, a sulfur atom, or an —NH— linking group.

X represents an oxygen atom, or a sulfur atom.

The resin containing at least one of the functional groups represented by formula (—O—L) can be prepared by a process comprising converting a hydroxyl group of a polymer into the functional group of formula (—O—L) through high molecular reaction, or a process comprising polymerizing at least one monomer containing at least one functional group of formula (—O—L) or copolymerizing such a monomer with other copolymerizable monomers.

For details of the above-described high molecular reaction, reference can be made to it, e.g., in Y. Iwakura and K. Kurita, *Hannosei Kobunshi*, p. 158, Kodansha. Conversion of a hydroxyl group of a monomer into the functional group of formula (—O—L) can be carried out by the process described, e.g., in Nihon Kagakukai (ed.), *Shin Jikken Kagaku Koza*, Vol. 14, "Yuki Kagobutsu no Gosei to Hanno (V)", p. 2497, Maruzen K. K.

The latter process utilizing polymerization of a monomer previously containing the functional group (—O—L) is preferred to the former process because the functional group (—O—L) in the polymer can be controlled arbitrarily and the polymer is free from incorporation of impurities. In some detail, a hydroxyl group(s) of a compound containing a polymerizable dobble bond and at least one hydroxyl group is or are converted to any of the functional groups (—O—L) and the resulting functional group-containing compound is polymerized, or a compound containing at least one of the functional groups (—O—L) is reacted with a compound having a polymerizable double bond in accordance with the methods described in the above cited references.

The monomer compound containing the functional group (—O—L) which can be used in the aforesaid polymerization process specifically includes those represented by formula (II):

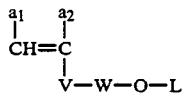

(II)

wherein V represents

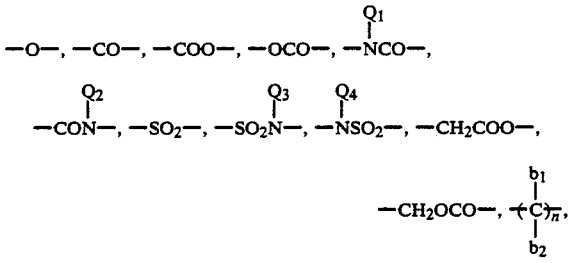

an aromatic group, or a heterocyclic group, wherein $Q_1$, $Q_2$, $Q_3$, and $Q_4$ each represents a hydrogen atom, a substituted or unsubstituted straight chain or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), a substituted or unsubstituted alicyclic group (e.g., cyclopentyl, cyclohexyl), a substituted or unsubstituted aralkyl group having from 7 to 12 carbon atoms (e.g., benzyl, phenethyl, fluorobenzyl, chlorobenzyl, methylbenzyl, methoxybenzyl, 3-phenylpropyl), a substituted or unsubstituted aromatic group (e.g., phenyl, naphthyl, chlorophenyl, tolyl, methoxyphenyl, methoxycarbonylphenyl, dichlorophenyl), or —O—$R_4$, wherein $R_4$ represents a hydrocarbon group as recited above, or the group —W—O—L in formula (II); $b_1$ and $b_2$, which may be the same or different, each represents a hydrogen atom, a substituted or unsubstituted straight chain or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), a substituted or unsubstituted alicyclic group (e.g., cyclopentyl, cyclohexyl), a substituted or unsubstituted aralkyl group having from 7 to 12 carbon atoms (e.g., benzyl, phenethyl, fluorobenzyl, chlorobenzyl, methylbenzyl, methoxybenzyl, 3-phenylpropyl), a substituted or unsubstituted aromatic group (e.g., phenyl, naphthyl, chlorophenyl, tolyl, methoxyphenyl, methoxycarbonylphenyl, dichlorophenyl), or —O—$R_4$, wherein $R_4$ represents a hydrocarbon group as recited above, or the group —W—O—L in formula (II); and n represents 0 or an integer of from 1 to 18; W represents a carbon-carbon bond for linking V and —O—L which may contain a hetero atom (e.g., oxygen, sulfur, or nitrogen); $a_1$ and $a_2$, which may be the same or different, each represents a hydrogen atom, a hydrocarbon group (preferably an alkyl group having from 1 to 12 carbon atoms, which may be substituted with a carboxyl group), a carboxyl group, or —COO—Z, wherein Z represents an alkyl, alkenyl, aralkyl, alicyclic, or aromatic group having from 1 to 18 carbon atoms which may be substituted with a group containing the group -0-L; and L is as defined above.

In formula (II], the linking group as represented by W is composed of one or more of divalent groups, e.g.,

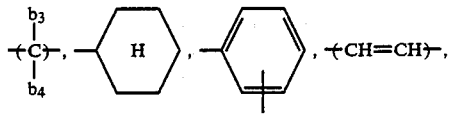

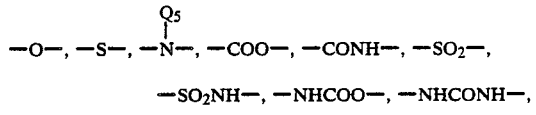

wherein $b_3$ and $b_4$ have the same meanings as $b_1$ and $b_2$, and $Q_5$ has the same meaning as $Q_1$, $Q_2$, $Q_3$, and $Q_4$.

Specific but nonlimitative examples of the monomer compound containing the functional group (—O—L) are shown below. In the following formulae, Me represents a methyl group.

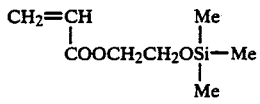

(1)

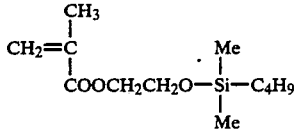

(2)

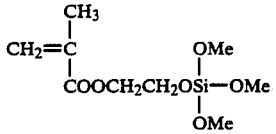

(3)

-continued
(4)
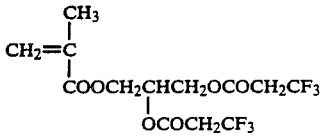
(5)
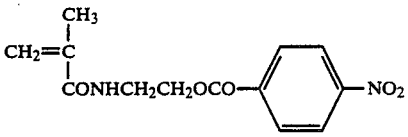
(6)
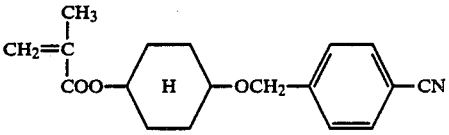
(7)
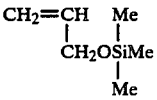
(8)
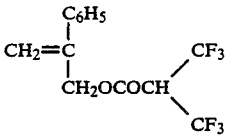
(9)
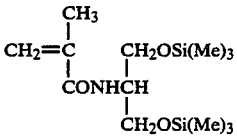
(10)
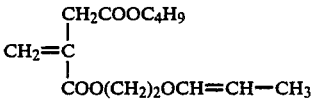
(11)
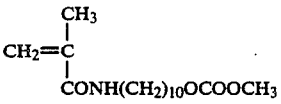
(12)
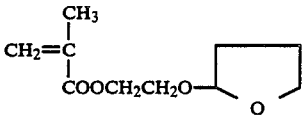
(13)
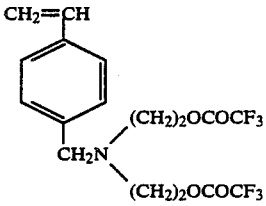
(14)
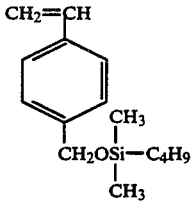
-continued
(15)
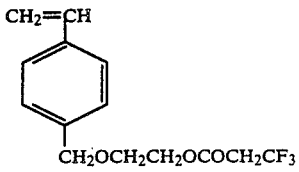
(16)
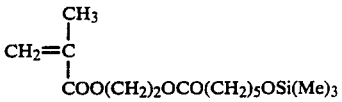
(17)
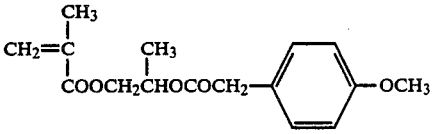
(18)
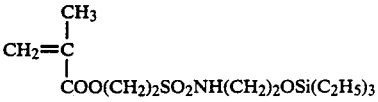
(19)
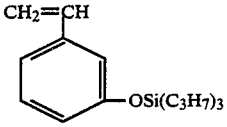
(20)
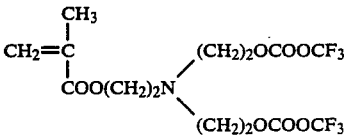
(21)
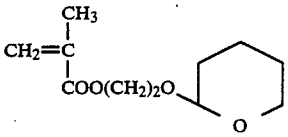
(22)
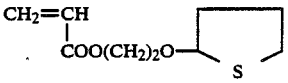
(23)
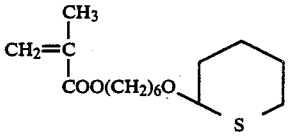
(24)
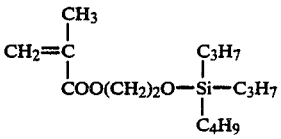
(25)
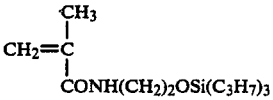
(26)
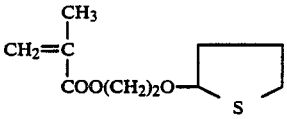

-continued (27)

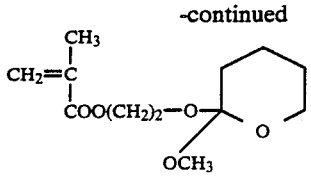

(28)

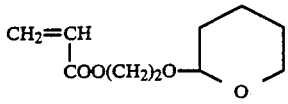

As stated above, these monomers may be either homopolymerized or copolymerized with other copolymerizable monomers. Examples of the comonomers to be used include vinyl or allyl esters of aliphatic carboxylic acids, e.g., vinyl acetate, vinyl propionate, vinyl butyrate, allyl acetate, allyl propionate; esters or amides of unsaturated carboxylic acids, e.g., acrylic acid, methacrylic acid, crotonic acid, itaconic acid, maleic acid, fumaric acid; styrene derivatives, e.g., styrene, vinyltoluene, α-methylstyrene; α-olefins; acrylonitrile, methacrylonitrile; and vinyl-substituted heterocyclic compounds, e.g., N-vinylpyrrolidone.

In another preferred embodiment according to the present invention, the hydroxyl-forming functional group-containing resin is a resin containing at least one functional group in which at least two hydroxyl groups spaced sterically close together are protected with one protective group.

Examples of such a functional group are those represented by formulae (III), (IV), and (V) shown below.

(III)

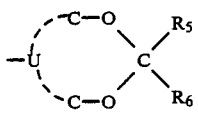

wherein $R_5$ and $R_6$, which may be the same or different, each represents a hydrogen atom, a hydrocarbon group, or —O—O—$R_7$, wherein $R_7$ represents a hydrocarbon group; and U represents a carbon-carbon bond —$(C)_n$— wherein n represents 0, 1, 2 or 3 which may contain a hetero atom.

(IV)

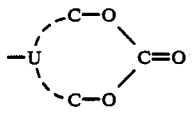

wherein U is as defined above.

(V)

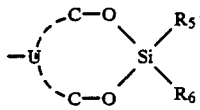

wherein $R_5$, $R_6$, and U are as defined above.

In formulae (III) and (V), $R_5$ and $R_6$, which may be the same or different, each preferably represents a hydrogen atom, a substituted or unsubstituted alkyl group having from 1 to 12 carbon atoms (e.g., methyl, ethyl, propyl, butyl, hexyl, 2-methoxyethyl, octyl), a substituted or unsubstituted aralkyl group having from 7 to 9 carbon atoms (e.g., benzyl, phenethyl, methylbenzyl, methoxybenzyl, chlorobenzyl), an alicyclic group having from 5 to 7 carbon atoms (e.g., cyclopentyl, cyclohexyl), a substituted or unsubstituted aryl group (e.g., phenyl, chlorophenyl, methoxyphenyl, methylpheny, cyanophenyl), or —O—$R_8$, wherein $R_8$ has the same meaning as the hydrocarbon group as represented by $R_5$ and $R_6$.

In formulae (III), (IV), and (V), U represents a carbon-carbon bond which may contain a hetero atom, which is selected so that the number of atoms between the two oxygen atoms is within 5.

The resin containing at least one of the above-described functional groups represented by formulae (III), (IV), and (V) can be prepared by a process comprising protecting two hydroxyl groups of a polymer which are positioned sterically close together with a protective group through a high molecular reaction, or a process comprising polymerizing at least one of the monomers containing two hydroxyl groups positioned sterically close together which have previously been protected with a protective group or copolymerizing such a monomer with other copolymerizable monomers, as described in J. F. W. Mc Omie, *Protective Groups in Organic Chemistry*, Chs. 3 and 4, Plenum. Press.

In the former process, the starting polymer comprises a polymer component in which two hydroxyl groups are spaced close together or a polymer component capable of providing two hydroxyl groups spaced close together on polymerization. Specific examples of these polymer components are shown below.

(i)

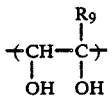

(ii)

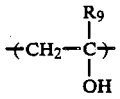

(iii)

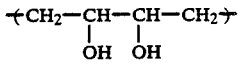

wherein $R_9$ represents a hydrogen atom or a substituent, e.g., a methyl group, (iv)

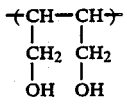

(v)

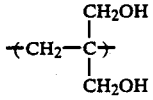

(vi)

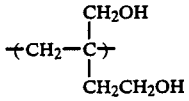

(vii)

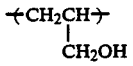

-continued (viii)

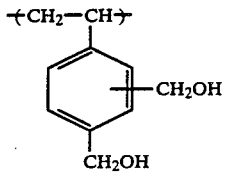

(ix)

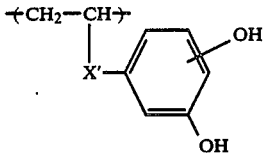

wherein X' represents a chemical bond or a linking group corresponding to the linking group V in formula (II) above.

The polymer containing the above-illustrated polymer component is reacted with a compound, such as carbonyl compounds, ortho ester compounds, halogen-substituted formic esters, dihalogen-substituted silyl compounds, to thereby form functional groups having at least two hydroxyl groups protected with one protective group. For details, reference can be made, e.g., in Nihon Kagakukai (ed.), *Shin Jikken Kagaku Koza*, Vol. 14, Yuki Kagobutsu no Gosei to Hanno (V), p. 2505, Maruzen K. K., J. F. W. Mc. Omie, *Protective Groups in Organic Chemistry*, Chs. 3 and 4, Plenum. Press.

In the latter process, a monomer with at least two hydroxyl groups thereof protected in advance is synthesized by known processes as described in the references cited above, and the resulting monomer is polymerized in a usual manner, if desired, in the presence of other copolymerizable monomer(s) to prepare a homo- or copolymer.

Specific but nonlimiting examples of the polymer component having two hydroxyl groups protected with one protective group are shown below.

(29)

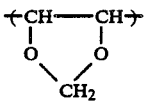

(30)

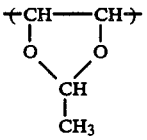

(31)

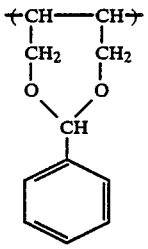

-continued (32)

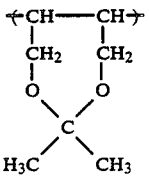

(33)

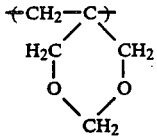

(34)

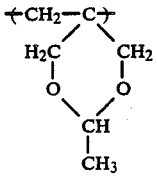

(35)

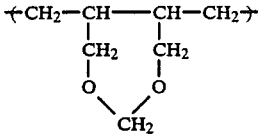

(36)

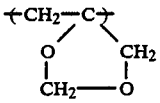

(37)

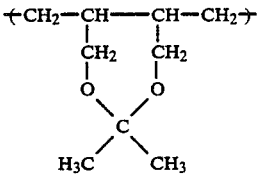

(38)

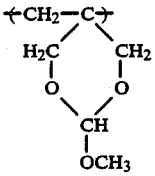

(39)

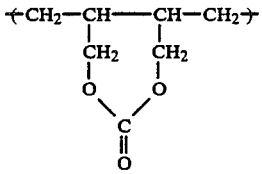

(40)

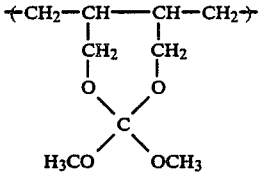

-continued (41)

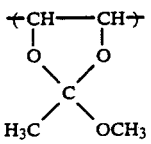

(42)

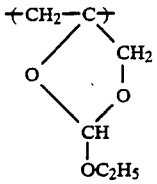

(43)

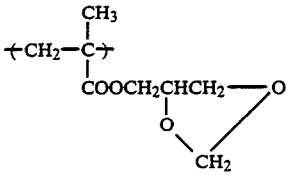

(44)

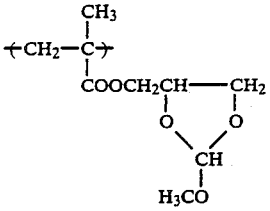

(45)

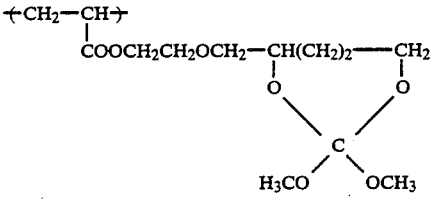

(46)

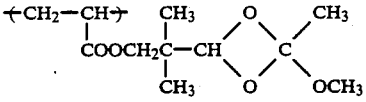

(47)

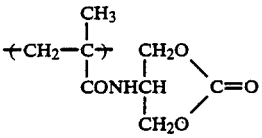

(48)

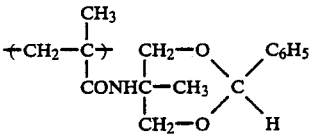

(49)

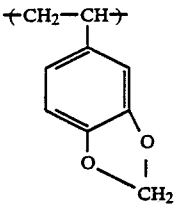

-continued (50)

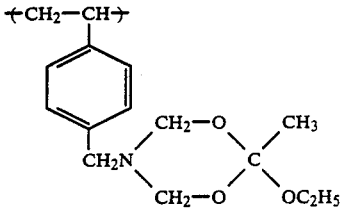

(51)

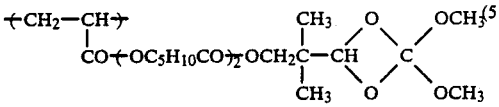

(52)

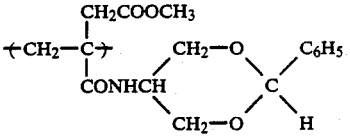

(53)

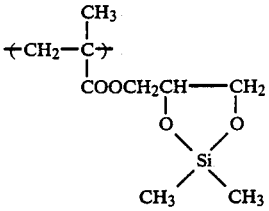

(54)

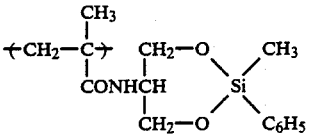

When the hydroxyl-forming functional group-containing polymer (A) is a copolymer, the proportion of the polymer component containing the hydroxyl-forming functional group in the copolymer is preferably from about 1 to about 95% by weight, and more preferably from about 5 to about 60% by weight. The polymer preferably has a molecular weight ranging from about $1\times10^3$ to about $1\times10^6$, and more preferably from about $5\times10^3$ to about $5\times10^5$.

In order to enhance cross linking effects between the resin (A) and the resin (B) and/or crosslinking agent, the resin (A) can contain a copolymer component containing a functional group which undergoes crosslinking reaction with the resin (B) and/or a crosslinking agent upon heating or irradiation of light. Such a functional group includes a group having at least one dissociative hydrogen atom, e.g., —OH, —SH, —NHR, wherein R represents an alkyl group having 1 to 8 carbon atoms (e.g., methyl, ethyl, propyl, butyl, hexyl) or an aryl group (e.g., phenyl, tolyl, methoxyphenyl, butylphenyl); an epoxy group, a thioepoxy group. The proportion of the copolymer component containing the above-described functional group in the resin (A) preferably ranges from about 1 to about 20% by weight, and more preferably from about 3 to about 10% by weight.

Monomers providing such a copolymer component include vinyl compounds containing the above-recited crosslinkable functional group which are copolymerizable with the hydroxyl-forming functional group-containing polymer component in the resin (A), for example, the compounds of formula (II).

These vinyl compounds are described, e.g., in High Molecular Society (ed.), *Kobunshi Data Handbook (Kiso-hen)*, Baihukan (1986). Specific examples of the vinyl compounds include acrylic acid, α- and/or β-substituted acrylic acids (e.g., α-acetoxyacrylic acid, α-acetoxymethylacrylic acid, α-(2-amino)methylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, α,β-dichloroacrylic acid), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid 4-methyl-2-hexenoic acid, 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, vinyl or allyl half esters of dicarboxylic acids, and ester or amide derivatives of these carboxylic acids or sulfonic acids having the aforesaid functional group in the substituent thereof. More specific examples are the compounds of formula (II) containing the aforesaid crosslinkable functional group in the substituents thereof.

If desired, in addition to the monomer component having the functional group of formula (I) and the above-described optional comonomer component containing the crosslinkable functional group, the resin (A) may further contain other copolymer components. Examples of such copolymer components include α-olefins, alkanoic acid vinyl or allyl esters, acrylonitrile, methacrylonitrile, vinyl ethers, acrylamides, methacrylamides, styrenes, heterocyclic vinyl compounds (e.g., vinylpyrrolidone, vinylpyridine, vinylimidazole, vinylthiophene, vinylimidazoline, vinylpyrazole, vinyldioxane, vinylquinoline, vinylthiazole, vinyloxazine). From the standpoint of film strength, vinyl acetate, allyl acetate, acrylonitrile, methacrylonitrile, and styrenes are particularly preferred.

The above-described resin (A) can be used either individually or in combination of two or more thereof.

The resin (B) for use in this invention is a known curable resin which undergoes crosslinking reaction by heat and/or light, and preferably a resin capable of crosslinking with the functional group in the resin (A).

The heat-curable resin is described, e.g., in T. Endo, *Netsukokasei Kobunshi no Seimitsuka*, C. M. C. (1986), Y. Harasaki, *Saishin Binder Gijutsu Binran*, Ch. II-1, Sogo Gijutsu Center (1985), T. Ohtsu, *Akuriru Jushi no Gosei Sekkei to Shin-yoto Kaihatsu*, Tyubu Keiei Kaihatsu Center Shuppan-bu (1985), and E. Ohmori, *Kinosei Akurrru-kei Jushi*, Techno System (1985). Examples of the heat-curable resin include polyester resins, modified or unmodified epoxy resins, polycarbonate resins, vinyl alkanoate resins, modified polyamide resins, phenolic resins, modified alkyd resins, melamine resins, acrylic resins, and isocyanate resins. The heat-curable resin preferably has a glass transition point (Tg) of about 10° C. to about 120° C.

The photocurable resin is described, e.g., in H. Inui and G. Nagamatsu, *Kankosei Kobunshi*, Kodansha (1977), T. Tsunoda, *Shin-kankosei Jushi*, Insatsu Gakkai Shuppan-bu (1981), G. E. Green and B. P. Stark, *J. Mcro. Sci. Reas. Macro Chem.*, C 21 (2), 187–273 (1981–1982), and C. G. Rattey, *Photopolymerization of Surface Coatings*, A. Wiley Interscience Publ. (1982). The photo-curable resin preferably has a glass transition point (Tg) of about 10° C. to about 120° C.

In more detail, the resin (B) includes a polymer containing a functional group capable of crosslinking by heating or irradiation of light. Implicit in such a crosslinkable functional group are those which undergo chemical bonding with different kinds of functional groups and self-crosslinkable functional groups. For example, the functional groups of the former type are selected from each of Group I and Group II tabulated below.

| Group I | Group II |
|---|---|
| Functional groups having a dissociative hydrogen atom: —OH, —SH, —$NHR_{10}$ (wherein $R_{10}$ is the same as the hydrocarbon group as fro $R_1$), —COOH, —$PO_3H_2$ | Functional groups capable of chemically bonding to the group of Group I: 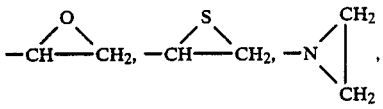 —N=C=O, —N=C=S, cyclic dicarboxylic acid anhydride groups |

The self-crosslinkable functional groups includes —$CONHCH_2OR_{11}$, wherein $R_{11}$ is a hydrogen atom, an alkyl group having from 1 to 6 carbon atoms (e.g., methyl, ethyl, propyl, butyl, hexyl), or a group having a polymerizable double bond represented by formula (C):

$$-X''-(CH_2)_r-\overset{X_1}{\overset{|}{C}}=\overset{X_2}{\overset{|}{C}}H \qquad (C)$$

wherein X'' represents —COO—, —OCO—, —CO—, —$SO_2$—, —CONH—, —$SO_2NH$—, —O—, —S—, an aromatic group, or a heterocyclic group; $X_1$ and $X_2$, which may be the same or different, each represents a hydrogen atom or a substituted or unsubstituted hydrocarbon group (e.g., methyl, ethyl, propyl, butyl, hexyl, carboxymethyl, methoxycarbonylmethyl, ethoxycarbonylmethyl, butoxycarbonylmethyl, 2-chloroethyl, 2-methoxyethyl, ethoxymethyl, benzyl, phenethyl, 3-phenylpropyl, chlorobenzyl, bromobenzyl, methylbenzyl, methoxybenzyl, phenyl, tolyl, xylyl, methoxyphenyl, chlorophenyl, bromophenyl); and r represents 0 or 1.

Monomers providing the copolymer component containing these crosslinkable functional groups include vinyl compounds containing such crosslinkable functional groups, and more specifically, the compounds described as for the resin (A) but containing crosslinkable functional groups. Monomers providing other copolymer components which are copolymerized with the crosslinkable functional group-containing copolymer component include those enumerated as for the resin (A).

It is preferable that the resin (B) contains from about 1 to about 80% by weight of the crosslinkable functional group-containing copolymer component. The resin (B) preferably has a weight average molecular weight of from $1\times10^3$ to $5\times10^5$, and more preferably from $5\times10^3$ to $5\times10^5$.

In cases wherein the resin binder according to the present invention comprises the resin (A) and the resin (B), a crosslinking reaction takes place between the resin (A) and the resin (B) and/or a self-crosslinking reaction takes place among the molecules of the resin (B). In these cases, the ratio of the resin (A) to resin (B) usually ranges from 5 to 80:95 to 20 by weight, and preferably from 15 to 60:85 to 40.

The crosslinking agent which can be used in combination with the resin (A) is selected from compounds commonly employed as crosslinking agents. Examples of usable crosslinking agents are described, e.g., in S. Yamashita and T. Kaneko (ed.), *Kakyozai Handbook*, Taiseisha (1981) and Kobunshi Gakkai (ed.), *Kobunshi Data Handbook (Kiso-hen)*, Baihukan (1986). Specific examples are organosilane compounds such as silane coupling agents (e.g., vinyltrimethoxysilane,, vinyltributoxysilane, γ-glycidoxypropyltrimethoxysilane, γ-mercaptopropyl-triethoxysilane, γ-aminopropyltriethoxysilane), polyisocyanate compounds (e.g., toluylene diisocyanate, o-toluylene diisocyanate, diphenylmethane diisocyanate, triphenylmethane triisocyanate, polymethylene polyphenyl isocyanate, hexamethylene diisocyanate, isophorone diisocyanate, polyisocyanates), polyol compounds (e.g., 1,4-butanediol, polyoxypropylene glycol, polyoxyalkylene glycols, 1,1,1-trimethylolpropane), polyamine compounds e.g., ethylenediamine, γ-hydroxypropylated ethylenediamine, phenylenediamine, hexamethylenediamine, N-aminoethylpiperazine, modified aliphatic polyamines), polyepoxy-containing compounds and epoxy resins (e.g., the compounds described in H. Kakiuchi (ed.), *Shinepoxy Jushi*, Shokodo (1985), and K. Hashimoto (ed.), *Epoxy Jushi*, Nikkan Kogyo Shinbunsha (1969)), melamine resins (e.g., the compounds described in I. Miwa and H. Matsunaga (ed.), *Urea Melamine Jushi*, Nikkan Kogyo Shinbunsha (1969)), and polyfunctional monomer compounds having at least two polymerizable double bonds (e.g., the compounds described in S. Ohgawara, T. Saegusa, and T. Higashimura (ed.), *Oligomer*, Kodansha (1976), and E. Ohmori, *Kinosei Akuriru-kei Jushi*, Techno System (1985)). Specific examples of these crosslinking agents are divinylbenzene, divinylglutaconic acid diesters, vinyl methacrylate, allyl methacrylate, ethylene glycol dimethacrylate, polyethylene glycol diacrylate, neopentylglycol diacrylate, 1,6-hexanediol diacrylate, trimethylolpropane triacrylate, pentaerythritol polyacrylate, bisphenol A diglycidyl ether diacrylate, oligoester acrylates; and the corresponding methacrylates. Of these crosslinking agents, isocyanate compounds, silane compounds, epoxy compounds and acrylate compounds are preferred.

The content of the crosslinking agent in the resin binder preferably ranges from about 0.1 to about 30% by weight, and more preferably from about 0.5 to about 20% by weight.

The resin binder according to the present invention contains either one or both of the resin (B) and the crosslinking agent. If desired, the resin binder may further contain a reaction accelerator. For example, in the case where the resin binder contains the resin (B) containing a heat-curable functional group, an acid, e.g., an organic acid (e.g., acetic acid, propionic acid, butyric acid) may be added as a reaction accelerator.

In the case where the resin binder contains the resin (B) containing a photo-crosslinkable functional group, the resin binder may further contain a sensitizer, a photopolymerizable monomer. Specific examples of these compounds are described in the references cited above with respect to photosensitive resins.

A photosensitive coating composition comprising zinc oxide and the resin binder of the invention is coated on a support and then subjected to a crosslinking reaction by heating or light irradiation. When the resin binder is heat-curable, the crosslinking is preferably carried out by drying the photosensitive coating at a high temperature and/or for a long time, or further heating the dried photosensitive coating, e.g., at 60° to 120° C. for 5 to 120 minutes. When the resin binder contains the photo-crosslinkable resin (B), the crosslinking can be effected by electron ray, X-ray, ultraviolet ray, or plasma beam irradiation. Such crosslinking may be conducted either during drying or before or after the drying. The reaction can be accelerated by heating under the above-described drying conditions.

The reaction can be made to proceed under milder conditions by using both the resin (B) and the crosslinking agent, or using the above-described reaction accelerator in combination, or by using the resin (A) having the above-described crosslinkable functional group.

The crosslinking reaction should be performed at least among the resins according to the present invention, but may be effected between the resins of the invention and other resins.

It is preferable that the resin of the present invention is such that it becomes insoluble or sparingly soluble in an acidic or alkaline aqueous solution after the hydroxyl-forming functional group thereof forms a hydroxyl group on decomposition.

In the present invention, conventionally known resins may also be used as a binder component in combination with the above-described resins according to the present invention. Such resins include silicone resins, alkyd resins, vinyl acetate resins, polyester resins, styrene-butadiene resins, acrylic resins, and the like as stated above. Specific examples of these resins are described, e.g., in T. Kurita and J. Ishiwatari, *Kobunshi*, Vol. 17, p. 278 (1968) and H. Miyamoto and H. Takei, *Imaging*, No. 8, p. 9 (1973).

The resin according to the present invention and the known resins may be used at broad mixing ratios, but, it is suitable that the hydroxyl-forming functional group-containing resin (A) be used in an amount of from about 1 to 90% by weight, and particularly from about 1 to 80% by weight when the resin binder contains the resin (B), based on the total resin binder. If the proportion of the resin (A) is less than 1% by weight, the resulting lithographic printing plate precursor does not show sufficient oil-desensitization when processed with an oil-desensitizing solution or dampening water, thus resulting in stain formation during printing. On the other hand, if it exceeds the upper limit recited above, the resulting printing plate precursor tends to have deteriorated image-forming performances.

In case when a conventional resin binder containing a hydroxyl group from the first is employed in the production of lithographic printing plate precursors, a dispersion of zinc oxide in this resin has an increased viscosity so that the photoconductive layer formed by coating such a dispersion has seriously deteriorated smoothness or insufficient film strength and is also unsatisfactory in electrophotographic characteristics. Even if a printing plate precursor having sufficient smoothness might be obtained, stains tend to be formed during printing. Hydroxyl groups contained in the conventional resin may be adjusted so as to produce a printing plate precursor which can reproduce a satisfactory image and provide a satisfactory print, but the quality of the reproduced image of the precursor is subject to deterioration due to changes of environmental conditions. That is, if the environmental conditions are changed during electrophotographic image formation processing, for example, to a low temperature and low humidity condition or a high temperature and high humidity condition (particularly, to a high temperature and high humidity condition), the reproduced image suffers from background fog, reduction in density of image areas, or disappearance of fine lines or letters.

These unfavorable phenomena accompanied by the conventional lithographic printing plate precursors are presumably attributed to the following. Since the interaction between the hydroxyl groups in the resin binder and the surfaces of photoconductive zinc oxide particles is strong, the resin adsorption on the surfaces of zinc oxide particles increases. As a result, compatibility of the photoconductive layer with an oil-desensitizing solution or dampening water is impaired. Otherwise, even when the hydroxyl groups in the resin binder may be adjusted adequately with respect to zinc oxide particles, the hydrophilic atmosphere on the boundaries between the hydroxyl groups in the resin and the zinc oxide particles greatly changes upon exposure to a low temperature and low humidity condition or a high temperature and high humidity condition so that electrophotographic characteristics, such as surface potential or dark decay after charging, are deteriorated.

The resin (A) according to the present invention which contains at least one functional group capable of forming a hydroxyl group is hydrolyzed or hydrogenoly-zed upon contact with an oil-desensitizing solution or dampening water used on printing to thereby form a hydroxyl group. Therefore, when the resin (A) is used as a binder for a lithographic printing plate precursor, hydrophilic properties of nonimage areas attained by processing with an oil-desensitizing solution can be enhanced by the thus formed hydroxyl groups. As a result, a marked contrast can be afforded between lipophilic properties of image areas and hydrophilic properties of nonimage areas to prevent adhesion of a printing ink onto the nonimage areas during printing. It has thus been realized to provide a lithographic printing plate capable of producing a larger number of prints having a clear image free from background stains as compared with lithographic printing plates prepared by using conventional resin binders.

Further, since the resin binder of the present invention contains the crosslinking agent and/or resin (B) which undergoes crosslinking with the resin (A), crosslinking reaction takes place during the formation of a photoconductive layer or heating and/or light irradiation before etching to form a crosslinked structure between polymers.

The resin containing a hydroxyl group formed on decomposition is rendered hydrophilic by etching treatment or treating with a dampening water during printing, and, with a high content of such a resin, the resin binder becomes water-soluble. However, since the resin binder of the present invention has a crosslinked structure formed by crosslinking with the resin (B) and/or the crosslinking agent, the binder becomes sparingly water-soluble or water-insoluble while retaining hydrophilic properties. Therefore, the effects of the hydroxyl group formed in the resin to impart hydrophilic properties to the nonimage areas are further ensured by such a crosslinked structure thereby improving printing durability of the printing plate.

Describing these effects more specifically, the present invention makes it possible to maintain the effects of improving hydrophilic properties even if the proportion of the functional group-containing resin in the total resin binder is decreased, or to produce a large number of clear prints free from background stains even if printing conditions are made more strict through an increase in size of a printing machine or a variation of printing pressure.

The photoconductive layer of the lithographic printing plate precursor according to the present invention usually comprises from about 10 to about 60 parts by weight, preferably from about 15 to about 40 parts by weight, and more preferably from 15 to 30 parts by weight, of the resin binder per 100 parts by weight of photoconductive zinc oxide. If desired, the photoconductive layer may further contain various dyes as spectral sensitizers, such as carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, styryl dyes), and phthalocyanine dyes inclusive of metallized phthalocyanine dyes, as described, e.g., in H. Miyamoto and H. Takei, *Imaging*, No. 8, p. 12 (1973).

More specifically, the carbonium dyes, triphenylmethane dyes, xanthene dyes, and phthalein dyes are described in JP-B-51-452, JP-A-50-90334, JP-A-50-114227, JP-A-53-39130, and JP-A-53-82353, U.S. Pat. Nos. 3,052,540 and 4,054,450, and JP-A-57-16456. The polymethine dyes, e.g., oxonol dyes, merocyanine dyes, cyanine dyes, and rhodacyanine dyes are described in F. M. Harmmer, *The Cyanine Dyes and Related Compounds*. Specific examples of these polymethine dyes are described in U.S. Pat. Nos. 3,047,384, 3,110,591, 3,121,008, 3,125,447, 3,128,179, 3,132,942, and 3,622,317, British Pat. Nos. 1,226,892, 1,309,274, and 1,405,898, and JP-B-48-7814 and JP-B-55-18892. Polymethine dyes which spectrally sensitize the near infrared to infrared regions of wavelengths longer than 700 nm are described in JP-A-47-840 and JP-A-47-44180, JP-B-51-41060, JP-A-49-5034, JP-A-49-45122, JP-A-57-46245, JP-A-56-35141, JP-A-57-157254, JP-A-61-26044, and JP-A-61-27551, U.S. Pat. Nos. 3,619,154 and 4,175,956, and *Research Disclosure*, 216, 117–118 (1982).

The photoconductive layer of the present invention is excellent in that its performance properties are not liable to variation due to the sensitizing dyes used.

The photoconductive layer may furthermore contain various additives known for electrophotographic photosensitive layer, such as chemical sensitizers. Examples of the additives include electron accepting compounds (e.g., halogen, benzoquinone, chloranil, acid anhydrides, organic carboxylic acids) as described in *Imaging*, No. 8, 12 (1973), and polyarylalkane compounds, hindered phenol compounds, and p-phenylenediamine compounds as described in H. Kokado, et al., *Saikin no Kododen Zairyo to Kankotai no Kaihatsu Jitsuyoka*, C.hs.

4–6, Nippon Kagaku Joho Shuppan-bu (1986). The amount of these additives is not particularly limited, but usually ranges from about 0.0001- to about 2.0 parts by weight per 100 parts by weight of a photoconductive substance.

The photoconductive layer can be provided on any known support usually to a thickness of from about 1 to about 100 μm, and preferably from about 10 to about 50 μm. In general, the support for an electrophotographic photosensitive layer is preferably electrically conductive. Any of conventionally employed conductive supports may be utilized in this invention. Examples of usable conductive supports include a base material (e.g., a metal sheet, paper, a plastic sheet) having been rendered electrically conductive by, for example, impregnating with a low resistant substance; a base material with its back side (i.e., the side opposite to the photosensitive layer) being rendered conductive an further coated thereon at least one layer for preventing curling; the aforesaid supports having further provided thereon a water resistant adhesive layer; the aforesaid supports having further provided thereon at least one precoat layer; and paper laminated with a plastic film on which aluminum is deposited.

Specific examples of the conductive supports and materials for imparting conductivity are described in S. Sakamoto, *Denshishashin*, Vol. 54, No. 1, pp. 2–11 (1975), H. Moriga, *Nyumon Tokushushi no Kagaku*, Kobunshi Kankokai (1975), and M. F. Hoover, *J. Macromol. Sci. Chem.*, A-4 (6), pp. 1327–1417 (1970).

The present invention will now be illustrated in greater detail by way of examples, but it should be understood that the present invention is not deemed to be limited thereto. In these examples, all the ratios are by weight unless otherwise specified.

EXAMPLE 1

A mixed solution consisting of 42 g of benzyl methacrylate, 8 g of 2-hydroxyethyl methacrylate, 50 g of a monomer compound of formula:

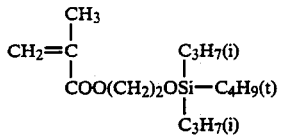

and 200 g of toluene was heated to 75° C. under a nitrogen stream, and 1.0 g of azobisisobutyronitrile (AIBN) was added thereto, and was allowed to react for 8 hours. The resulting copolymer was designated as (A-1). The copolymer (A-1) had a weight average molecular weight (Mw) of 42,000.

A mixture of 30 g (as solid content) of (A-1), 10 g of a butyl methacrylate/acrylic acid copolymer (99/1; Mw =45,000), 200 g of zinc oxide, 0.05 g of Rose Bengale, 0.01 g of phthalic anhydride, and 300 g of toluene was dispersed in a ball mill for 2 hours. To the dispersion was added 6 g of hexamethylene diisocyanate, and the mixture was further dispersed in a ball mill for 10 minutes to prepare a photosensitive coating composition. The composition was coated on paper having been rendered electrically conductive to a dry coverage of 25 g/m$^2$ with a wire bar, followed by drying at 100° C.. for 60 minutes. The photosensitive layer was then allowed to stand in a dark place at 20° C.. and 65% RH (relative humidity) for 24 hours to produce an electrophotographic lithographic printing plate precursor.

COMPARATIVE EXAMPLE 1

A mixed solution consisting of 60 g of benzyl methacrylate, 40 g of Compound (2), and 200 g of toluene was heated to 70° C. under a nitrogen stream, and 1.0 g of AIBN was added thereto. The mixture was allowed to react for 8 hours. The resulting copolymer had an Mw of 45,000.

A mixture of 30 g (as solid content) of the resulting copolymer, 10 g of a butyl methacrylate/acrylic acid copolymer (98/2; Mw =45,000), 200 g of zinc oxide, 0.05 g of Rose Bengale, 0.01 g of phthalic anhydride, and 300 g of toluene was dispersed in a ball mill for 2 hours to prepare a photosensitive coating composition. The composition was coated on paper having been rendered conductive to a dry coverage of 25 g/m$^2$ with a wire bar, followed by drying at 110° C.. for 1 minute. The photosensitive layer was then allowed to stand in a dark place at 20° C. and 65% RH for 24 hours to produce an electrophotographic lithographic printing plate precursor.

COMPARATIVE EXAMPLE 2

A mixed solution consisting of 85 g of benzyl methacrylate, 15 g of 2-hydroxyethyl methacrylate, and 200 g of toluene was subjected to polymerization reaction in the same manner as in Comparative Example 1. The resulting copolymer had an Mw of 42,000.

An electrophotographic lithographic printing plate precursor was produced in the same manner as in Comparative Example 1, except for using the above prepared copolymer.

COMPARATIVE EXAMPLE 3

An electrophotographic lithographic printing plate precursor was produced in the same manner as in Comparative Example 1, except for using 40 g of a butyl methacrylate/acrylic acid ,99/1) copolymer (Mw=45,000) as a resin binder.

Each of the lithographic printing plate precursors obtained in Example 1 and Comparative Examples 1 to 3 was evaluated for film properties in terms of surface smoothness, electrostatic characteristics, oildesensitization of the photoconductive layer in terms of contact angle with water after oil-desensitization, and printing performances in terms of stain resistance in accordance with the following test methods.

(1) Smoothness of Photoconductive Layer:

The smoothness (sec/cc) was measured by means of a Beck smoothness tester manufactured by Kumagaya Riko K. K. under a condition of an air volume of 1 cc.

(2) Electrostatic Characteristics:

The sample was negatively charged by corona discharge to a voltage of −6 kV for 20 seconds in a dark room at 20° C.. and 65% RH using a paper analyzer ("Paper Analyzer SP-428" manufactured by Kawaguchi Denki K. K.). After the sample was allowed to stand for 10 seconds, the surface potential $V_0$ was measured. Then, the photoconductive layer was irradiated with visible light at an illumination of 2.0 lux, and the time required to reduce the surface potential $V_0$ to one-tenth was measured. The exposure amount $E_{1/10}$ (lux.sec) was then calculated therefrom.

(3) Contact Angle with Water:

The sample was passed once through an etching processor using an oil-desensitizing solution ("ELP-E", produced by Fuji Photo Film Co., Ltd.) to oil-desensitize the surface of the photoconductive layer. On the thus oil-desensitized surface was placed a drop of 2 μl of distilled water, and the contact angle formed between the surface and water was measured by a goniometer.

(4) Image Quality:

The sample was allowed to stand under an ambient condition of 20° C., 65% RH (hereinafter referred to as Condition I) or a high temperature and high humidity condition of 30° C. and 80% RH (hereinafter referred to as Condition II) for a whole day and then processed using an automatic camera processor "ELP 404V" (manufactured by Fuji Photo Film Co., Ltd.) which had also been allowed to stand under Conditions I or II, respectively. The image reproduced on the resulting printing plate was visually evaluated in terms of fog and image quality.

(5) Resistance to Background Stain:

The sample was processed with ELP 404V to form a toner image, and the surface of the photoconductive layer was subjected to oil-desensitization under the same conditions as in (3) above. The resulting printing plate was mounted on an offset printing machine "Hamada Star 800SX" (manufactured by Hamada Star K.K.), and printing was carried out on fine paper in a usual manner (hereinafter referred to as Condition I) to obtain 500 prints. All the resulting prints were visually evaluated for background stains.

The same evaluation was repeated, except that the printing was carried out under more severe conditions, i.e., by using a 5-fold diluted oil-desensitizing solution and a 2-fold diluted dampening water for printing, and that the printing pressure applied was made higher (hereinafter referred to as Condition II).

The results of these evaluations are shown in Table 1 below.

TABLE 1

| | Example | Comparative Example | | |
|---|---|---|---|---|
| | 1 | 1 | 2 | 3 |
| Smoothness of Photoconductive Layer (sec/cc) | 85 | 85 | 80 | 80 |
| Electrostatic Characteristics: | | | | |
| $V_0$ (−V) | 550 | 550 | 540 | 550 |
| $E_{1/10}$ (*lux · sec*) | 8.5 | 8.5 | 8.0 | 9.0 |
| Contact Angle with Water (degree) | 5 or less | 5 or less | 18 | 15 to 28 (widely scattered) |
| Quality of Reproduced Image:* | | | | |
| Condition I | Good | Good | Good | Fair |
| Condition II | Good | Good | Good | Very poor |
| Resistance to Background Stain: | | | | |
| Condition I | No stain | No stain | No stain | Small amount of stains |
| Condition II | More than 10,000 prints free form stains | Stains observed from the 7,000th print | Stains observed from the 5,000th print | Stains observed from the start of printing |

*Note:
Good = Image of high density and no fog
Fair = Small degree of fog
Poor = Image of low density and high degree of fog
Very Poor = Unclear image due to image of low density which is highly fogged.

From the results of Table 1, the following considerations can be derived.

The printing plate obtained by using any of the photosensitive material containing the crosslinking agent according to the present invention and the comparative photosensitive materials had a clear reproduced image when processed under an ambient condition (Condition I), but the reproduced image of the samples of Comparative Examples 2 and 3 suffered serious deterioration in quality when processed under a high temperature and high humidity condition (Condition II). Namely, the image underwent background fog and had a density of 0.6 or less.

The samples of Example 1 and Comparative Example 1 showed a contact angle with water as small as 5° or less, indicating that the surface of the photoconductive layer was rendered sufficiently hydrophilic.

When each of the printing plates was used as a master plate for offset printing, only those of Example 1 and Comparative Example 1 proved excellent in resistance to background stains. When each of these two printing plates was used for obtaining 10,000 prints under a higher printing pressure, the 10,000th print obtained in Example 1 had satisfactory image quality and was free from background stains, whereas the plate of Comparative Example 1 caused background stains from about the 7,000th print. The printing plate of Comparative Example 3 caused serious background stains from about the 500th print.

It can thus been seen that only the photosensitive material according to the present invention always reproduces a clear image irrespective of a variation of environmental conditions during processing and provides a printing plate exhibiting printing durability of more than 10,000 prints.

EXAMPLES 2 TO 11

An electrophotographic lithographic printing plate precursor was produced in the same manner as in Example 1, except for replacing (A-1) with each of the copolymer resins shown in Table 2 below.

TABLE 2

Copolymer Component:

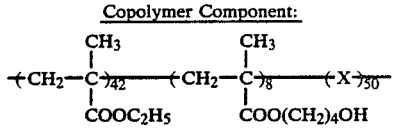

| Example No. | Copolymer Resin (A) | Chemical Structure of X in Copolymer Component | Mw |
|---|---|---|---|
| 2 | (A-2) | 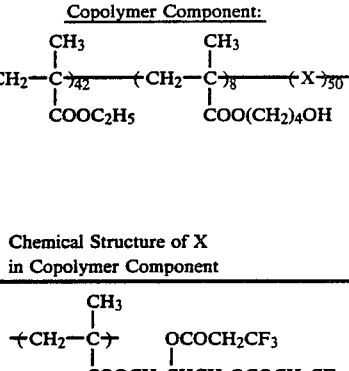 | 53,000 |
| 3 | (A-3) | 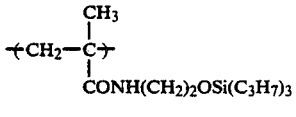 | 49,000 |
| 4 | (A-4) | 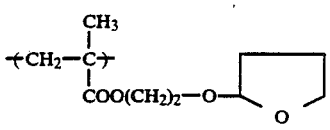 | 55,000 |

TABLE 2-continued

Copolymer Component:

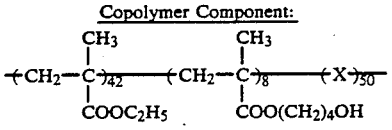

| Example No. | Copolymer Resin (A) | Chemical Structure of X in Copolymer Component | Mw |
|---|---|---|---|
| 5 | (A-5) | 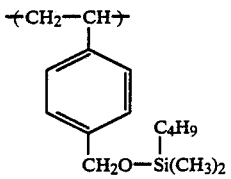 | 45,000 |
| 6 | (A-6) | 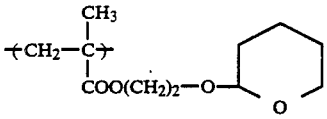 | 52,000 |
| 7 | (A-7) | 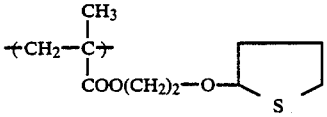 | 53,000 |
| 8 | (A-8) | 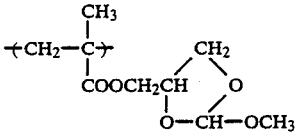 | 50,000 |
| 9 | (A-9) | 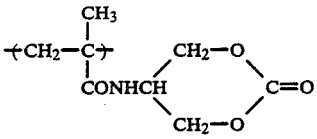 | 52,000 |
| 10 | (A-10) | 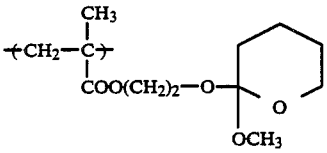 | 49,000 |
| 11 | (A-11) | 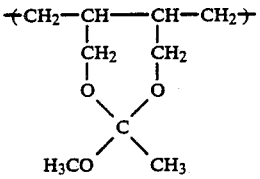 | 60,000 |

Each of the resulting printing plate precursors was processed by means of ELP 404V in the same manner as in Example 1. The resulting master plate for offset printing had a clear reproduced image having a density of 1.2 or more. After etching treatment, the master plate was used or printing. The prints after obtaining 10,000 prints had a clear image free from fog on the nonimage areas.

Further, when the precursor was allowed to stand at 45° C. and 75% RH for two weeks and then processed in the same manner as described above, the results of printing were quite equal to those obtained above.

EXAMPLE 12

A mixture having the same composition as used in Example 1, except for using 30 g of a copolymer (A-12) having the following formula (Mw =42,000) in place of (A-1) and further using 4 g of hexamethylene diisocyanate was dispersed in a ball mill for 2 hours to obtain a photosensitive coating composition.

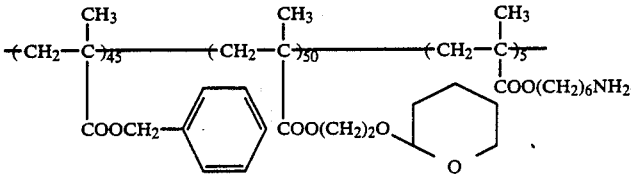

(A-12)

An electrophotographic printing plate precursor was produced in the same manner as in Example 1, but by using the above-prepared coating composition. When the printing plate precursor was processed in the same manner as in Example 1, the resulting master plate for offset printing reproduced a clear image having a density of 1.0 or more. After etching, printing was carried out by using the resulting printing plate. As a result, more than 10,000 prints having a clear image free from fog were obtained.

Further, when the printing plate precursor was allowed to stand at 45° C. and 75% RH for two weeks and then processed in the same manner as above, the results of printing were entirely equal to those obtained above.

EXAMPLES 13 TO 17

An electrophotographic lithographic printing plate precursor was produced in the same manner as in Example 1, except for replacing hexamethylene diisocyanate as used in Example 1 with each of the crosslinking agents shown in Table 3 below.

TABLE 3

| Example No. | Crosslinking Agent |
|---|---|
| 13 | Ethylene glycol diglycidyl ether |
| 14 | Eponit 012 (trade name, produced by Nitto Kasei K.K.) |
| 15 | Rika Resin PO-24 (trade name, produced by New Japan Chemical Co., Ltd.) |
| 16 | Diphenylmethane diisocyanate |
| 17 | Triphenylmethane triisocyanate |

Each of the resulting printing plate precursors was processed in the same manner as in Example 1 and then etched. The master plate for offset printing as obtained by processing had a clear reproduced image having a density of 1.0 or more. When printing was carried out using the resulting printing plate, more than 10,000 prints having a clear image free from background fog were obtained.

EXAMPLE 18

A mixed solution consisting of 50 g of ethyl methacrylate, 20 g of Compound (2), 30 g of ally methacrylate, and 400 g of toluene was heated to 75° C. under a nitrogen stream, and 1.0 g of AIBN was added thereto, and allowed to react for 8 hours. The resulting copolymer was designated as (A-13). The copolymer (A-13) had an Mw of 65,000.

A mixture of 20 g (as solid content) of (A-13), 20 g of a butyl methacrylate/allyl methacrylate/acrylic acid copolymer (B-1) (78/20/2; Mw =34,000), 200 g of zinc oxide, 0.05 g of Rose Bengale, 0.01 g of phthalic anhydride, and 300 g of toluene was dispersed in a ball mill for 2 hours. To the dispersion were added 10 g of allyl methacrylate and 0.5 g of AIBN, and the mixture was further dispersed in a ball mill for 10 minutes to prepare a photosensitive coating composition. The composition was coated on paper having been rendered conductive to a dry coverage of 25 g/m$^2$ with a wire bar, followed by drying at 100° C. for 60 minutes. The photosensitive layer was then allowed to stand in a dark place at 20° C. and 65% RH, for 24 hours to produce an electrophotographic lithographic printing plate precursor.

COMPARATIVE EXAMPLE 4

A mixture consisting of 20 g of polyethyl methacrylate (Mw =62,000), 20 g of a butyl methacrylate/acrylic acid copolymer (98/2; Mw =35,000), 200 g of zinc oxide, 0.05 g of Rose Bengale, 0.01 g of phthalic anhydride, and 300 g of toluene was dispersed in a ball mill for 2 hours to prepare a photosensitive coating composition. An electrophotographic printing plate precursor was produced in the same manner as in Example 18, except for using the above-prepared coating composition.

COMPARATIVE EXAMPLE 5

A copolymer was prepared in the same manner as in Example 18, except for using a mixed solution consisting of 80 g of ethyl methacrylate, 20 g of Compound (2), and 200 g of toluene. The resulting copolymer had an Mw of 63,000. An electrophotographic printing plate precursor was produced in the same manner as in Comparative Example 4, except for using 20 g of the above-prepared copolymer in place of the polyethyl methacrylate as used in Comparative Example 4.

COMPARATIVE EXAMPLE 6

A copolymer was prepared in the same manner as in Example 18, except for using a mixed solution consisting of 80 g of ethyl methacrylate, 20 g of 2-hydroxyethyl methacrylate, and 200 g of toluene. The resulting copolymer had an Mw of 58,000. An electrophographic printing plate precursor was produced in the same manner as in Comparative Example 4, except for using 20 g of the above-prepared copolymer in place of the polyethyl methacrylate as used in Comparative Example 4.

Each of the printing plate precursors obtained in Example 18 and Comparative Examples 4 to 6 was evaluated in the same manner as in Example 1. The results obtained are shown in Table 4 below.

TABLE 4

| | Example | Comparative Example | | |
|---|---|---|---|---|
| | 18 | 4 | 5 | 6 |
| Smoothness of | 80 | 75 | 80 | 65 |

TABLE 4-continued

| | Example | Comparative Example | | |
|---|---|---|---|---|
| | 18 | 4 | 5 | 6 |
| Photoconductive Layer (sec/cc) Electrostatic Characteristics: | | | | |
| $V_0$ (−V) | 550 | 550 | 550 | 550 |
| $E_{1/10}$ (lux · sec) | 8 | 8 | 8.5 | 9.5 |
| Contact Angle with Water (degree) | 8 | 22 | 9 | 12 to 20 (widely scattered) |
| Quality of Reproduced Image: | | | | |
| Condition I | Good | Good | Good | Fair |
| Condition II | Good | Good | Good | Poor |
| Resistance to Background Stain: | | | | |
| Condition I | No stain | Stains | No stain | Small amount of stains |
| Condition II | More than 10,000 prints free form stains | Stains observed from the start of printing | 7,500 prints free from stains | Stains observed from the start of printing |

From the results of Table 4, the following can be derived.

The printing plate obtained by using any of the photosensitive material containing the resin (B) according to the present invention and the photosensitive materials of Comparative Examples 4 and 5 had a clear reproduced image when processed under an ambient condition (Condition I), but the sample of Comparative Example 6 had a seriously deteriorated smoothness, and the image reproduced thereon was not clear due to considerable fog on the nonimage areas. When this sample was processed under a high temperature and high humidity condition (Condition II), the reproduced image was further deteriorated. Namely, the image underwent background fog and had an image density of 0.6 or less.

The samples of Example 18 and Comparative Example 5 showed a contact angle with water as small as 9° or less, indicating that the surface of the photoconductive layer was rendered sufficiently hydrophilic.

When each of the printing plates was used as a master plate for offset printing, only the printing plates of Example 18 and Comparative Example 5 proved excellent in resistance to background stains. When each of these printing plates was used for printing under a higher printing pressure, the printing plate of Example 18 produced more than 10,000 prints having satisfactory image quality without suffering background stains, whereas the printing plate obtained in Comparative Example 5 caused background stains from about the 7,500th print.

When the sample of Example 18 was allowed to stand at 45° C. and 75% RH for 1 week and then evaluated for electrophotographic characteristics and printing performance properties in the same manner as in Example 1, no appreciable changes of results were observed.

It can thus been seen that only the photosensitive material according to the present invention always reproduces a clear image irrespective of a variation of environmental conditions during processing and provides a printing plate exhibiting printing durability of more than 10,000 prints.

EXAMPLES 19 TO 26

A copolymer was synthesized in the same manner as in Example 18, except for using a mixed solution consisting of 50 g of benzyl methacrylate, 30 g of each of the compounds shown in Table 5, 20 g of vinyl methacrylate, and 400 g of toluene.

TABLE 5

| Example No. | Copolymer Resin (A) | Copolymer Component in Resin A | Mw |
|---|---|---|---|
| 19 | (A-14) | 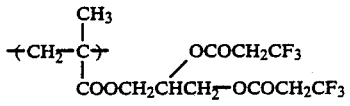 | 57,000 |
| 20 | (A-15) | 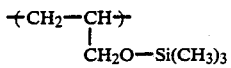 | 55,000 |
| 21 | (A-16) | 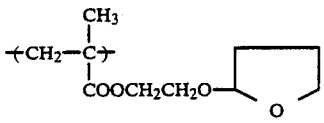 | 58,000 |
| 22 | (A-17) | 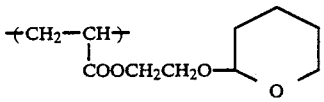 | 54,000 |
| 23 | (A-18) | 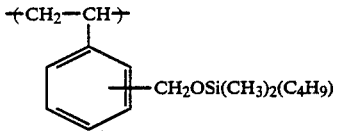 | 49,000 |
| 24 | (A-19) | 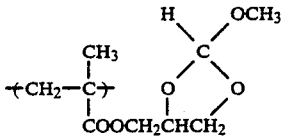 | 52,000 |
| 25 | (A-20) | 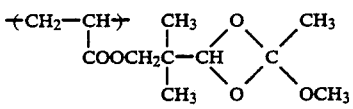 | 53,000 |
| 26 | (A-21) | 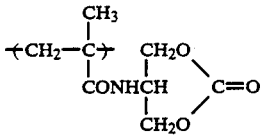 | 50,000 |

An electrophotographic lithographic printing plate precursor was produced in the same manner as in Example 18, except for replacing (A-13) with 20 g of each of the resulting copolymers (A-14) to (A-26).

The printing plate precursor was processed by means of the same processor as used in Example 18. The resulting master plate for offset printing had a clear image having a density of 1.0 or more. After etching treatment, printing was carried out using the resulting printing plate. As a result, more than 10,000 clear prints free from fog were obtained.

Further, the printing plate precursor was allowed to stand at 45° C. and 75% RH for 2 weeks and then processed in the same manner as above. The results of printing were entirely equal to those obtained above.

EXAMPLES 27 AND 28

A mixture having the same composition as in Example 18, except for replacing (A-13}with 24 g of a copolymer having the following formula (A-22) (Mw =36,000) and replacing (B-1) with 16 g of each of the copolymers shown in Table 6 below, was dispersed in a ball mill for 2 hours to prepare a photosensitive coating composition.

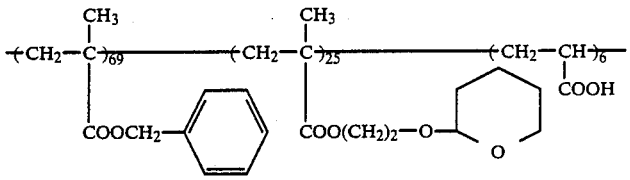

(A-22)

TABLE 6

| Example No. | Resin (B) | Structure of Resin (B) | Mw |
|---|---|---|---|
| 27 | (B-2) |  | 40,000 |
| 28 | (B-3) | 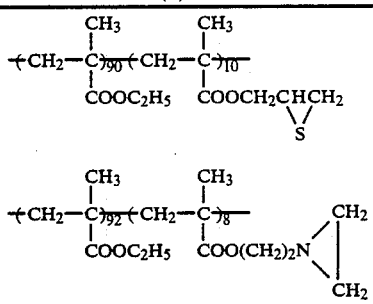 | 35,000 |

The resulting coating composition was coated on paper having been rendered electrically conductive with a wire bar coater to a dry coverage of 25 g/m$^2$ and dried at 100° C. for 1 hour. The thus-formed photoconductive layer was allowed to stand in a dark place at 20° C. and 65% RH for 24 hours to obtain an electrophotographic lithographic printing plate precursor.

Each of the resulting printing plate precursors was processed by means of the same processor as used in Example 18. The resulting master plate for offset printing had a clear image having a density of 1.0 or more. After etching, printing was carried out by using the resulting printing plate. There were obtained more than 10,000 prints having a clear image free from fog.

As described above, the present invention makes it possible to provide an electrophotographic lithographic printing plate precursor which produces a printing plate having superior stain resistance and printing durability.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic printing plate precursor comprising a conductive support having provided thereon at least one photoconductive layer containing photoconductive zinc oxide and a resin binder, wherein said resin binder comprises at least one resin (A) containing at least one functional group capable of forming at least one hydroxyl group upon decomposition by treatment with an oil-desensitizing solution or dampening water and at least one member selected from group (B) consisting of a heat- and/or photo-curable resin (B) and a crosslinking agent (B).

2. An electrophotographic lithographic printing plate precursor as claimed in claim 1, wherein said resin (A) is a resin containing at least one functional group represented by formula (I):

$$-O-L \qquad (I)$$

wherein L is selected from the group consisting of $$-\overset{\overset{R_1}{|}}{\underset{\underset{R_3}{|}}{Si}}-R_2,\ -CO-Y_1,\ -CO-T-Y_2,\ -CH=CH-CH_3,$$

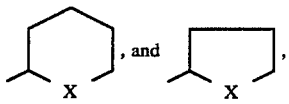

wherein $R_1$, $R_2$, and $R_3$, which may be the same or different, are each selected from the group consisting of a hydrogen atom, a hydrocarbon group, and —O—R′, wherein R′ represents a hydrocarbon group; X is selected from the group consisting of a sulfur atom and an oxygen atom; $Y_1$ and $Y_2$ each represents a hydrocarbon group; and T is selected from the group consisting of an oxygen atom, a sulfur atom, and —NH—.

3. An electrophotographic lithographic printing plate precursor as claimed in claim 2, wherein said resin (A) is a resin obtained by polymerizing a monomer represented by formula (II):

$$\overset{a_1}{\overset{|}{CH}}=\overset{a_2}{\overset{|}{C}}-V-W-O-L \qquad (II)$$

wherein V is selected from the group consisting of $$-O-,\ -CO-,\ -COO-,\ -OCO-,\ -\overset{\overset{Q_1}{|}}{N}CO-,$$

$$-\overset{\overset{Q_2}{|}}{N}CO-,\ -SO_2-,\ -SO_2\overset{\overset{Q_3}{|}}{N}-,\ -\overset{\overset{Q_4}{|}}{N}SO_2-,\ -CH_2COO-,$$

$$-CH_2OCO-,\ -\left(\overset{\overset{b_1}{|}}{\underset{\underset{b_2}{|}}{C}}\right)_n-,$$

heterocyclic group, wherein $Q_1$, $Q_2$, $Q_3$, and $Q_4$ are each selected from the group consisting of a hydrogen atom, a hydrocarbon group, and the group —W—O—L in formula (II); $b_1$ and $b_2$, which may be the same or different, are each selected from the group consisting of a hydrogen atom, a hydrocarbon group, and the group —W—O—L in formula (II); and n represents 0 or an integer of from 1 to 18; W represents a carbon-carbon bond for linking V and —O—L which may contain a hetero atom; $a_1$ and $a_2$, which may be the same or different, are each selected from the group consisting of a hydrogen atom, a hydrocarbon group, a hydroxyl group, and —COO—Z, wherein Z is selected from the group consisting of an alkyl, alkenyl, aralkyl, alicyclic, and an aromatic group having 1 to 18 carbon atoms which may be substituted with a group containing the group —O—L; and L is as defined in claim 2.

4. An electrophotographic lithographic printing plate precursor as claimed in claim 1, wherein said resin (A) is a resin containing at least one functional group in which at least two hydroxyl groups spaced sterically close together are protected with one protective group.

5. An electrophotographic lithographic printing plate precursor as claimed in claim 4, wherein said functional group is selected from a group represented by formula (III):

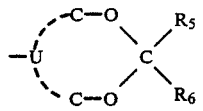

(III)

wherein $R_5$ and $R_6$, which may be the same or different, are each selected from the group consisting of a hydrogen atom, a hydrocarbon group, and —O—O—$R_7$, wherein $R_7$ represents a hydrocarbon group; and U represents a —(C.)$_n$—wherein n is 0, 1, 2 or 3 which may contain a hetero atom;

a group represented by formula (IV):

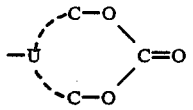

(IV)

wherein U is as defined above;

and a group represented by formula (V):

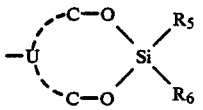

(V)

wherein $R_5$, $R_6$, and U are as defined above.

6. An electrophotographic lithographic printing plate precursor as claimed in claim 1, wherein said resin (A) contains a copolymer component containing a functional group capable of crosslinking with the resin (B) and/or the crosslinking agent (B) by heating or irradiation of light.

7. An electrophotographic lithographic printing plate precursor as claimed in claim 1, wherein said resin (A) is present in an amount of from about 1 to about 90% by weight based on the total resin binder.

8. An electrophotographic lithographic printing plate precursor as claimed in claim 1, wherein (B) is a heat- and/or photo-curable resin and wherein the weight ratio of the resin (A) to the resin (B) is from about 5 to 80:95 to 20.

9. An electrophotographic lithographic printing plate precursor as claimed in claim 1, wherein said crosslinking agent is present in an amount of from about 0.1 to about 30% by weight based on the total resin binder.

10. An electrophotographic lithographic printing plate precursor as claimed in claim 1, wherein said resin binder comprises resin A and crosslinking agent (B).

* * * * *